US008753078B2

(12) United States Patent
Speed et al.

(10) Patent No.: US 8,753,078 B2
(45) Date of Patent: Jun. 17, 2014

(54) GUIDE VANE ASSEMBLY

(75) Inventors: Keith R. F. Speed, Bristol (GB); Keith C. Sadler, Bristol (GB)

(73) Assignee: Rolls-Royce plc, London (GB)

( * ) Notice: Subject to any disclaimer, the term of this patent is extended or adjusted under 35 U.S.C. 154(b) by 1067 days.

(21) Appl. No.: 12/761,082

(22) Filed: Apr. 15, 2010

(65) Prior Publication Data

US 2010/0310360 A1 Dec. 9, 2010

(30) Foreign Application Priority Data

Jun. 3, 2009 (GB) ..... 0909470.7

(51) Int. Cl.
*F01D 25/28* (2006.01)
*F01D 1/02* (2006.01)

(52) U.S. Cl.
USPC ..... 415/208.2; 415/196; 415/213.1

(58) Field of Classification Search
USPC ..... 415/208.2, 173.1, 173.4, 174.4, 213.1, 415/196
See application file for complete search history.

(56) References Cited

U.S. PATENT DOCUMENTS

| | | | | |
|---|---|---|---|---|
| 4,522,559 | A * | 6/1985 | Burge et al. | 415/196 |
| 4,759,687 | A * | 7/1988 | Miraucourt et al. | 415/127 |
| 4,875,828 | A * | 10/1989 | Willkop et al. | 415/173.4 |
| 6,126,389 | A | 10/2000 | Burdgick | |
| 2006/0083607 | A1 * | 4/2006 | Synnott et al. | 415/173.1 |
| 2007/0237624 | A1 | 10/2007 | Nigmatulin | |
| 2008/0298956 | A1 * | 12/2008 | Eastman et al. | 415/173.1 |
| 2009/0096174 | A1 * | 4/2009 | Spangler et al. | 277/345 |

OTHER PUBLICATIONS

Great Britain Search Report issued on Sep. 29, 2009 in Great Britain Patent Application No. GB0909470.7.

* cited by examiner

*Primary Examiner* — Nathaniel Wiehe
*Assistant Examiner* — Aaron Jagoda
(74) *Attorney, Agent, or Firm* — Oliff PLC

(57) ABSTRACT

A guide vane assembly for a turbomachine, comprising a guide vane and a liner: the guide vane comprising an aerofoil portion having a radially outer platform, wherein one of the outer platform and the liner has a hook element, the hook element comprising an opening and a circumferentially extending channel, and the other one of the outer platform and the liner comprises a retaining element having a head portion, wherein in an operational orientation the head portion located within the channel and is too wide to be withdrawn through the opening of the hook element.

20 Claims, 3 Drawing Sheets

GUIDE VANE ASSEMBLY

This invention relates to a guide vane assembly, and particularly but not exclusively to a guide vane assembly for a turbomachine, comprising a guide vane and a liner.

BACKGROUND

A turbomachine, in particular a gas turbine engine, may comprise guide vanes in order to direct gas flows generated by the compressor and turbine stages of an engine. These vanes generally act between the stages of the engine to direct and guide the gas flow.

The nozzle guide vane assembly is one of the most difficult areas of design because the vanes sustain the highest temperature in the engine and they must perform an efficient aerodynamic function on the hot gases which flow from the combustion chamber. The gases typically have an entry temperature between 850 and 1700° C. and may reach velocities of over 750 meters per second.

Guide vanes are often made as an annular array of separate vanes, each vane comprising an aerofoil and inner and outer platforms formed integrally with the aerofoil.

In order to maintain a high level of efficiency it is necessary to prevent leakage of the hot gases and this is of particular importance at the circumferential interfaces between the separate vanes which make up the guide vane and at the axial interfaces of the guide vane array with the preceding and following components of the turbomachine.

However, the operating conditions are such that components in the turbomachine exhibit different rates of expansion and contraction. This brings about geometric relationships that change considerably during use, which makes it difficult to seal one section of the turbomachine from another to prevent leakage of gas between the two portions.

As shown in FIG. 1, the guide vane 2 comprises an aerofoil portion 4 and an outer platform 6. The outer platform 6 of the guide vane 2 is coupled at one end to a liner 8. The liner 8 sits radially outside a blade 10. Similarly to the guide vane 2, the liner 8 may be made as an annular array of separate liners, each liner being associated with a corresponding guide vane 2.

The guide vane assembly comprising the guide vane 2 and the liner 8 is coupled to the radially exterior casing components of the turbomachine at one end via the radial projection 12 of the guide vane 2. The radial projection 12 is sandwiched between the casing element 14 and the previous casing element. The radial projection 12 prevents axial displacement of the guide vane 2. However the radial projection need not be load bearing since the aerofoil portion 4 provides structural support for the outer platform 6. In fact, the radial projection 12 is sandwiched between the adjacent casing elements in such a manner that the guide vane may expand radially.

The guide vane assembly is coupled to the radially exterior components of the turbomachine at its other end via the radial projection 16 of the liner 8. Since the liner 8 is not structurally supported, the interface further comprises a liner hanger 18 which projects axially from the casing element 18. The liner hanger 18 is received within a recess 20 in the liner 8 and acts to retain the liner 8 radially.

It is known to couple the guide vane 2 to the liner 8 via a "bird's mouth" interface. In such a bird's mouth interface the liner 8 terminates in a bifurcated jaw 22 for receiving a projection 24 of the outer platform 6 of the guide vane 2. This interface between the guide vane 2 and the liner 8 provides for a certain amount of relative axial displacement between the guide vane 2 and the liner 8. As well as axial displacement, the components also experience relative radial displacement caused by thermal expansion, G-forces and gyroscopic loads. Radial displacement of the guide vane 2, particularly the outer platform 6 of the guide vane 2 caused by expansion of the aerofoil portion 4, relative to the liner 8 causes the bifurcated jaw 22 to be splayed. The splayed jaw 22 thus allows the interface to provide the necessary radial displacement between the components. However the splayed jaw 22 increases the amount of gas leaked through the interface and thus this configuration is not best suited to applications where there is radial displacement between the guide vane 2 and the liner 8 and a high level of hermetical sealing is required.

It is an object of the present invention to provide an improved interface between the guide vane and the liner and to allow for radial displacement without excess leakage through the interface.

STATEMENTS OF INVENTION

According to a first aspect of the present invention there is provided a guide vane assembly for a turbomachine, comprising a guide vane and a liner: the guide vane comprising an aerofoil portion having a radially outer platform; wherein one of the outer platform and the liner has a hook element, the hook element comprising an opening and a circumferentially extending channel; and the other one of the outer platform and the liner comprises a retaining element having a head portion, wherein in an operational orientation the head portion is located within the channel and is too wide to be withdrawn through the opening of the hook element.

According to a second aspect of the present invention there is provided a guide vane assembly for a turbomachine, comprising a guide vane and a liner: the guide vane comprising an aerofoil portion having a radially outer platform, the outer platform having a hook element, the hook element comprising an opening and a circumferentially extending channel; the liner comprising a retaining element having a neck portion and a head portion, wherein the head portion is thicker and the neck portion thinner than the width of the opening of the hook element; wherein, in use, the head portion is located within the channel.

The head portion may be of complementary cross-section to the channel of the hook element.

The liner may further comprise a second radially extending retaining element.

The second retaining element may comprise a recess which, in use, holds an element of the turbomachine casing.

The recess may be located adjacent the axially foremost position of the liner.

The head portion may comprise a protuberance. The protuberance may extend across only a portion of the radial width of the liner.

The portion of the liner without the protuberance may be provided to allow the head portion of the retaining element to be inserted into the channel of the hook element.

The hook element may comprise a substantially radial lip.

The rear of the head portion may have a substantially radial abutting wall.

During relative radial and/or axial displacement of the liner and guide vane, the cross-sections of the head portion of the liner and the hook element of the guide vane may be such that abutting surfaces of the head portion and hook are forced against each other.

The abutting surfaces may be the top of the lip and the underside of the neck portion, and/or the bottom of the head portion and the bottom of the channel. The abutting surfaces may be radial surfaces of the lip and the rear of the head portion.

The guide vane may be a nozzle guide vane, an inlet guide vane or an outlet guide vane.

The head portion may be shaped such that it may be withdrawn through the opening in an orientation other than the operational orientation.

The head portion may be wider than the opening, such that it cannot be withdrawn through the opening in any orientation.

A guide vane array may comprise a circumferentially extending array of guide vane assemblies.

The guide vane at the top dead centre of the array may have a liner with a head portion which is thinner than the width of the opening of the hook element, even in the operational orientation, to allow it to be installed as the final liner in the array.

The guide vane assembly may be used in a turbomachine.

BRIEF DESCRIPTION OF THE DRAWINGS

For a better understanding of the present invention, and to show more clearly how it may be carried into effect, reference will now be made, by way of example, to the accompanying drawings, in which:—

DETAILED DESCRIPTION

Figure 2:
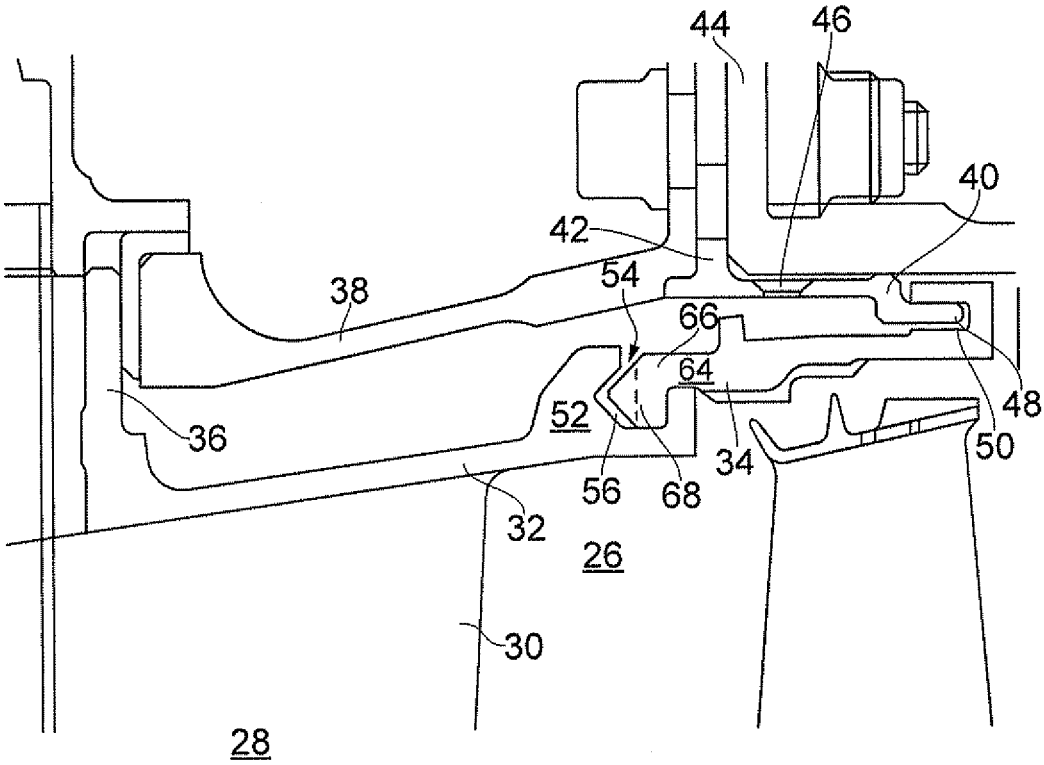
FIG. 2 shows a cross-sectional side elevation of a guide vane assembly according to a first embodiment of the invention.

FIG. 2 illustrates a guide vane assembly 26 for a turbomachine in accordance with a first embodiment of the invention. As shown in FIG. 2, the guide vane assembly 26 comprises a guide vane 28, the guide vane 28 having an aerofoil portion 30 and an outer platform 32, the guide vane assembly 26 further comprising a liner 34. The outer platform 32 of the guide vane is coupled at one end to the liner 34. The liner 34 sits radially outside a blade 8. The guide vane assembly 26 is part of a circumferentially extending array of similar guide vane assemblies that form a complete guide vane array. In such a guide vane array each liner 34 is associated with a corresponding guide vane 28. However this need not be the case and the guide vane array could comprise a different number of guide vanes to liners. The guide vanes 28 are assembled such that the outer platforms 32 of the guide vanes 28 form a concentric ring and the liners 34 are assembled such that they form another concentric ring. The adjacent surfaces of the outer platforms 32 may abut one another, as may the adjacent surfaces of the liners 34. The interface between the adjacent surfaces of the outer platforms 32 and/or liners 34 may be covered by a seal strip to prevent gas from leaking through the interface. The seal strip may additionally comprise a mechanical key which is sandwiched between the adjacent surfaces.

Figure 1:
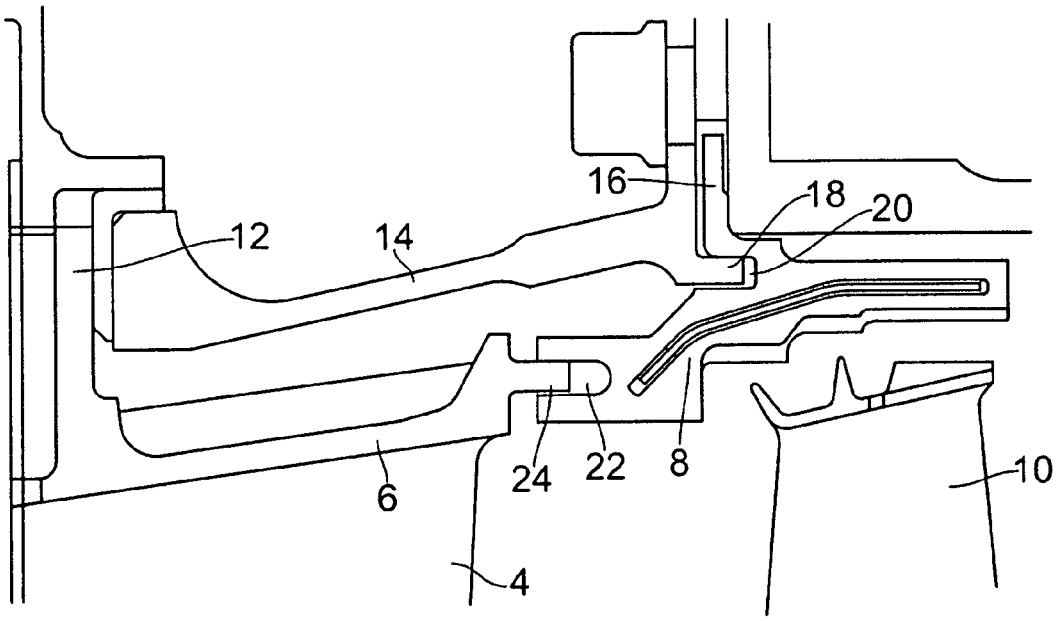
Prior Art FIG. 1
FIG. 1 shows a cross-sectional side elevation of a known guide vane assembly.

Similarly to the example shown in FIG. 1, the guide vane assembly 26, comprising the guide vane 28 and the liner 34, is coupled to the radially exterior components of the turbomachine at one end via the radial projection 36 of the guide vane 28. The radial projection 36 is sandwiched between the casing element 38 and the previous casing element.

The radial projection 36 locates the guide vane 28 in the axial direction. However the radial projection need not be load bearing since the aerofoil portion 30 provides structural support for the outer platform 32. In fact, the radial projection 36 is sandwiched between the casing elements in such a manner that the guide vane 28 may be displaced radially relative to the casing elements.

The guide vane assembly 26 is coupled to the radially exterior components of the turbomachine at its other end via the liner hanger element 40. The liner hanger element 40 comprises a radial projection 42 which is sandwiched between casing elements 38 and 44 and prevents axial displacement of the liner hanger element 40. The liner hanger element 40 is affixed to the casing element 44 by fixing means 46 and thus the radial projection 42 also prevents rotation of the liner hanger element 40 about the fixing means 46. The liner hanger element 40 further comprises a liner hanger 48 which projects axially from the liner hanger element 40. The liner hanger 48 is received within a recess 50 of the liner 34 and acts to retain the liner 34 radially.

Figure 3:
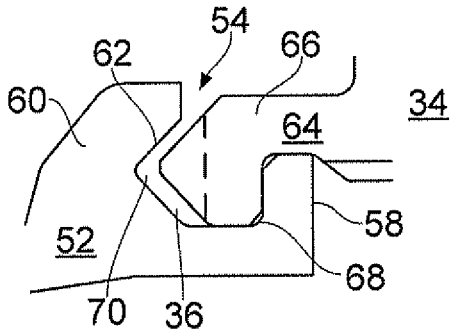
FIG. 3 shows an enlarged cross-sectional side elevation of the guide vane assembly of FIG. 2.
Figure 4:
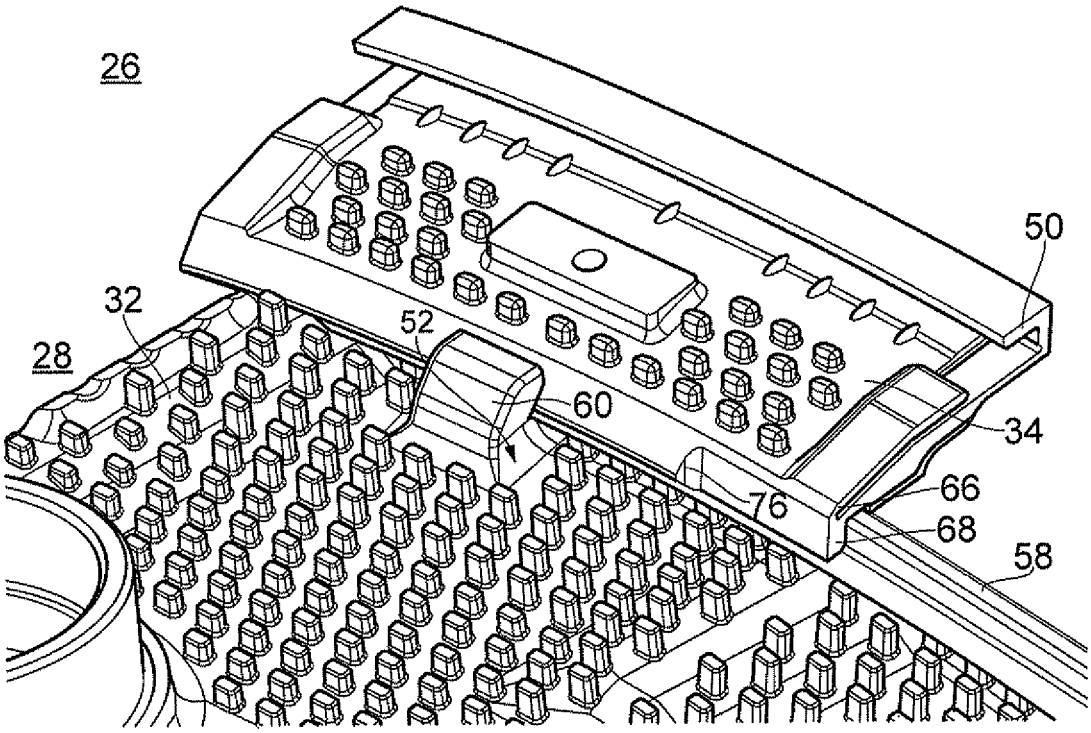
FIG. 4 shows a perspective view of the guide vane assembly of FIGS. 2 and 3.

The interface which couples the guide vane 28 and the liner 34 will now be described with reference to FIG. 3, which shows an enlarged view of the interface as shown in FIG. 2, and FIG. 4.

The outer platform 32 of the guide vane 28 has a hook element 52 at the opposite axial side to the radial projection 36. The hook element 52 extends circumferentially across a portion of the outer platform 32, as shown in FIG. 4. The hook element 52 comprises an opening 54 and a radially extending channel 56, which are defined by the lip 58 and the wall 60. The lip 58 projects in a substantially radial direction. The lip 58 extends circumferentially across the whole of the outer platform 32 and thus forms a contiguous lip in the assembled array. The wall 60 extends circumferentially across a portion of the outer platform 32. The wall 60 has an indentation 62 in its face, resulting in the channel 56 having a cross-section which is, at least in part, wider in an axial direction than the opening 54. To couple the liner 34 to the guide vane 28, the liner 34 has a retaining element 64. The retaining element 64 has a neck portion 66 and a head portion 68. The cross-section of the head portion 68 is complementary to the cross-section of the channel 56 of the hook element 52 and is suitably sized to be received within the channel 56 with some play. In particular the head portion 68 comprises a protuberance 70 (the portion to the left of the dashed line in FIG. 3) of similar cross-section to the indentation 62 in the wall 60. The presence of the protuberance 70 results in the head being of greater thickness than the neck portion 66. The neck portion 66 is thinner than the opening 54 to the channel 56 and the head portion 68 is thicker than the opening 54. As a result of this configuration the retaining element 64 is located within the channel 56 of the hook element 52 when in an operational orientation and is too wide to be withdrawn through the opening 54 of the hook element 52 during relative radial and axial displacement.

Although the present embodiment maintains the retaining element 64 within the channel 56 through the use of the indentation 62 and the complementary cross-section of the protuberance 70 of the retaining element 64, it is to be understood that various alternatives could be used to achieve the same result. However, the configuration described and shown in FIGS. 2 to 4 provides the interface with additional benefits, as will be described in more detail below.

In a second embodiment the head portion 68 is shaped such that, when in an operational orientation, the head portion is located within the channel 56 and is too wide to be withdrawn through the opening 54. However, in an orientation other than the operational orientation the head portion 68 can be withdrawn through the opening 54.

The operational orientation refers to the relative alignment of the guide vane 28 and liner 34 when the guide vane assembly 26 is incorporated into the turbomachine. The operational orientation clearly can be attained without incorporating the guide vane assembly 26 into the turbomachine and the term should be construed accordingly. Orientations other than the operational orientation are orientations where the guide vane 28 and liner 34 are rotated relative to one another, so that the head portion 68 is rotated within the hook element 52. Such orientations are not, or should not be, possible in normal operation of the turbomachine. The term orientation should not be construed to refer to relative circumferential positions of the guide vane 28 and liner 34.

In use, a plurality of guide vane assemblies are coupled to form a circumferentially extending guide vane array. As described previously, the retaining element 64 is retained within the hook element 52 and thus prevents the liner 34 from becoming detached from the outer platform 32. This is particularly important with the liners at the bottom of the array and also prevents the liners from reacting to the pressure loads.

Since the head portion 68 is thicker than the opening 54 to the channel 56 in the first embodiment, the head portion 68 must enter the hook element 52 from a circumferential direction. This is achieved by first hooking the retaining element 64 of the liner 34 over the lip 58 of the guide vane 28 and then rotating the liner 34 to slide the retaining element 62 through the channel 56 until the guide vane 28 and liner 34 are adjacent to the next guide vane assembly in the array. The hook element 52 is preferably located at substantially the centre of the width of the liner 34. This is important under operating conditions, since thermal effects can cause each liner 34 to flatten and the positioning of the hook element at the centre of the liner 34 allows this to occur. To facilitate the assembly of the guide vane 28 and the liner 34, the protuberance 70 may extend circumferentially along only a portion of the liner 34, as shown in FIG. 4. The portion of the liner 34 without the protuberance 70 is preferably larger than the width of the hook element 62. To allow insertion of the final liner in the assembly, the final liner being the liner at top dead centre, the final liner may not have a protuberance.

In the second embodiment the head portion 68 can enter the hook element 52 directly through the opening 54 by angling the liner 34 from the operational orientation. This therefore removes the need for the head portion 68 to enter the hook element 52 from a circumferential direction, as in the first embodiment. As a result, in the second embodiment the protuberance 70 may extend along the whole width of the liner 34. Once in the operational orientation, the head portion 68 is retained in the channel 56 by engagement of the head portion 68 with the hook element 52, the head portion 68 being too wide to be withdrawn through the opening 54.

Alternatively, the liners 34 and guide vanes 28 may be assembled into separate arrays which are subsequently connected to one another. In this respect, the array of liners 34 are positioned so that the retaining elements 64 of the liners 34 are hooked over the circumferentially extending lip 58 of the guide vanes 28. To connect the array of liners 34 to the array of guide vanes 28, the two arrays are then rotated with respect to one another to slide the retaining elements 62 through the channels 56 so that the retaining elements 64 of the liners 34 are located within the hook elements 52 of the guide vanes 28. Preferably this is achieved by rotating the array of liners 34 with respect to the array of guide vanes 28. This alternative assembly method removes the need for the final liner to not have a protuberance 70.

The dimensions of the recess 50 and the liner hanger 48 are such that the recess 50 can move axially and also radially relative to the liner hanger 48. The radial movement of the recess 50 allows the liner 34 to rotate about the liner hanger 48 toward or away from the axial direction. In contrast to the liner hanger 18 shown in FIG. 1, the liner hanger 48 is positioned axially further into the turbomachine by virtue of the liner hanger element 40. The axial translation of the pivot, liner hanger 48, accentuates the rotation of the liner 34 at the interface between the liner 34 and the guide vane 28 and thus allows for a greater degree of radial displacement of the guide vane 28.

Axial expansion of the guide vane 28 and/or liner 34 causes the liner 34 to translate axially. However the liner 34 remains retained on the liner hanger 48 due the following casing element (as shown in FIG. 2). As a result, the retaining element 64 of the liner 34 translates axially and the protuberance 70 abuts the indentation 62 in the wall 60. Both the protuberance 70 and the indentation 62 are divided into an upper wall and a lower wall. The dimensions of the protuberance are such that its upper wall contacts the upper wall of the indentation 62. Since the upper walls are angled axially forwards into the turbomachine, any force between the two walls produces a radial component towards the central axis of the turbomachine. This acts to reinforce the abutment between the substantially axial abutting surfaces. The abutting surfaces being the top of the lip 58 and the underside of the neck portion 66 and/or the bottom of the head portion 68 and the bottom of the channel 56. This therefore improves the sealing of the interface to prevent gas leakage. The lower wall of the protuberance 70 is shown as being angled, however this need not be the case and the lower wall could instead extend in a substantially radial direction.

Conversely, axial contraction of the vane 28 and/or liner 34 causes the liner 34 to translate axially. Once the liner hanger 48 contacts the recess 50, the liner 34 is prevented from translating any further. The radial faces of the rear of the head portion 68 and the lip 58 abut one another and are forced together. Therefore axial contraction creates an improved seal at the interface and prevents gas leakage.

Radial expansion of the guide vane 28 and/or liner 34 causes the liner 34 to translate radially. This acts to reinforce the abutment between the substantially axial abutting surfaces. The abutting surfaces being the top of the lip 58 and the underside of the neck portion 66 and/or the bottom of the head portion 68 and the bottom of the channel 56. This therefore improves the sealing of the interface to prevent gas leakage.

Radial contraction of the guide vane 28 and/or liner 34 causes the retaining element 64 of the liner 34 to translate radially within the channel 56 so that the upper walls of the protuberance 70 and the indentation 62 abut one another. Since the upper walls are angled axially forwards into the turbomachine, any force between the two walls produces a forward axial component. This acts to reinforce the abutment between the radial faces of the lip 58 and the rear of the head portion 68 and thus improves the sealing of the interface to prevent gas leakage.

If the guide vane 28 expands or contracts radially and the liner 34 does not expand or contract, or does not expand or contract at the same rate as the guide vane 28, this causes the liner 34 to rotate about the liner hanger 48 toward or away from the axial direction. In either case, the rotation of the liner 34 relative to the outer platform 32 results in the abutment of the upper walls of the protuberance 70 and the indentation 62.

Since the upper walls are angled axially forwards into the turbomachine, any force between the two walls produces a forward axial component. This acts to reinforce the abutment between the substantially axial and/or radial abutting surfaces. The abutting surfaces may, for example, be the radial faces of the lip 58 and the rear of the head portion 68, the top of the lip 58 and the underside of the neck portion 66 of the liner 34, and the bottom of the head portion 68 and the bottom of the channel 56, and any combination of these surfaces. This therefore improves the sealing of the interface to prevent gas leakage.

The terms expansion and contraction are used above in an exemplary manner to refer to relative displacement between components, however the components may be displaced in corresponding directions without the components expanding or contracting but whilst still exhibiting the characteristics described above. Accordingly these terms should be construed broadly and may refer to any displacement of components which occurs under operating conditions.

The known guide vane assembly shown in FIG. 1 has the bird's mouth interface described previously. Such an interface comprises the bifurcated jaw 22 and the projection 24 that abut at substantially parallel axial surfaces. These parallel axial surfaces face upstream (to the left in FIG. 1). As can be seen in FIGS. 2 and 3, the interfaces between both the guide vane 28 and the liner 34 and between the guide vane assembly 26 and the preceding and following casing elements, are arranged in such a manner so as to remove any upstream facing parallel interfaces. Instead any parallel interfaces are directed downstream which reduces the amount of leakage through the interface.

The present invention has been described such that the outer platform 32 of the guide vane 28 comprises the hook element 52 and the liner 34 comprises the retaining element 64. However this need not be the case and in an alternative configuration the outer platform 32 may in fact comprise the retaining element 64 and the liner 34 may comprise the hook element 52. The various features and embodiments described herein equally may be applied to such an alternative configuration.

The guide vane of the present invention may be any type of guide vane; however the invention is particularly advantageous when used with a nozzle guide vane due to the high temperatures and loads experienced by nozzle guide vanes.

The present invention may be easily adopted by producing the interface components using existing radial grinding operations.

The present invention also enables cooling fins to be applied further rearwards on the outer platform 32 than is possible in the known guide vane assembly.

As has been described above, the present invention allows both axial and radial displacement of the guide vane 28 and the liner 34 whilst providing improved sealing.

To avoid unnecessary duplication of effort and repetition of text in the specification, certain features are described in relation to only one or several aspects or embodiments of the invention. However, it is to be understood that, where it is technically possible, features described in relation to any aspect or embodiment of the invention may also be used with any other aspect or embodiment of the invention.

The invention claimed is:

1. A guide vane assembly for a turbomachine, comprising:

a guide vane and a liner in axial series, the guide vane and liner being coupled together at axially adjacent ends thereof by a hook element and retaining element;

the guide vane comprising an aerofoil portion having a radially outer platform; wherein one of the outer platform and the liner has the hook element, the hook element comprising a radially extending lip and a wall which define an opening and a circumferentially extending channel therebetween; and the other one of the outer platform and the liner comprises the retaining element having a head portion, wherein in an operational orientation the head portion is located within the channel and is too wide to be withdrawn through the opening of the hook element.

2. A guide vane assembly as claimed in claim 1, wherein the head portion is of complementary cross-section to the channel of the hook element.

3. A guide vane assembly as claimed in claim 2, wherein the liner further comprises a second radially extending retaining element.

4. A guide vane assembly as claimed in claim 1, wherein the liner further comprises a second radially extending retaining element.

5. A guide vane assembly as claimed in claim 4, wherein the second retaining element comprises a recess which, in use, holds an element of the turbomachine casing.

6. A guide vane assembly as claimed in claim 5, wherein the recess is located adjacent the axially aftmost position of the liner.

7. A guide vane assembly as claimed in claim 1, wherein the head portion comprises a protuberance.

8. A guide vane assembly as claimed in claim 7, wherein the protuberance extends across only a portion of the radial width of the liner.

9. A guide vane assembly as claimed in claim 7, wherein a portion of the liner without a protuberance is provided to allow the head portion of the retaining element to be inserted into the channel of the hook element.

10. A guide vane assembly as claimed in claim 1, wherein the hook element comprises a substantially radial lip.

11. A guide vane assembly as claimed in claim 1, wherein the rear of the head portion has a substantially radial abutting wall.

12. A guide vane assembly as claimed in claim 1, wherein during relative radial and/or axial displacement of the liner and guide vane, the cross-sections of the head portion of the liner and the hook element of the guide vane are such that abutting surfaces of the head portion and hook are forced against each other.

13. A guide vane assembly as claimed in claim 12, wherein the hook element comprises a substantially radial lip, and wherein the abutting surfaces are the top of the lip and the underside of a neck portion of the retaining element, and/or the bottom of the head portion and the bottom of the channel.

14. A guide vane assembly as claimed in claim 12, wherein the hook element comprises a substantially radial lip, and wherein the abutting surfaces are radial surfaces of the lip and the rear of the head portion.

15. A guide vane assembly as claimed in claim 1, wherein the guide vane is a nozzle guide vane, an inlet guide vane or an outlet guide vane.

16. A guide vane assembly as claimed in claim 1, wherein the head portion is shaped such that it can be withdrawn through the opening in an orientation other than the operational orientation.

17. A guide vane assembly as claimed in claim 1, wherein the head portion includes a protuberance that is wider than the opening, the protuberance configured such that it cannot be withdrawn through the opening in any orientation.

18. A guide vane array comprising the guide vane assembly as claimed in claim 1, wherein the guide vane array comprises a circumferentially extending array of guide vane assemblies.

19. A guide vane array as claimed in claim 18, wherein the guide vane at the top dead centre of the array has a liner with a head portion which is thinner than the width of the opening of the hook element to allow it to be installed as the final liner in the array.

20. A turbomachine comprising the guide vane assembly as claimed in claim 1.

* * * * *